United States Patent [19]

Whittemore, Jr.

[11] 4,440,847

[45] Apr. 3, 1984

[54] DIAZO MATERIAL WITH WATERBORNE DRAFTING SUBBING COMPOSITION OF ACRYLIC RESIN AND AZIRIDINE AND PROCESS OF USING

[75] Inventor: Jesse E. Whittemore, Jr., Guilford, Conn.

[73] Assignee: AM International, Inc., Chicago, Ill.

[21] Appl. No.: 409,842

[22] Filed: Aug. 20, 1982

[51] Int. Cl.[3] ..... G03C 1/76; G03C 1/52; G03C 5/34

[52] U.S. Cl. ..... 430/146; 430/150; 430/159; 430/160; 430/169; 430/533; 430/534; 430/535; 430/625; 427/302; 427/393.5; 428/483

[58] Field of Search ..... 430/159, 160, 169, 625, 430/533, 534, 535, 146, 150; 427/393.5, 302; 428/483

[56] References Cited

U.S. PATENT DOCUMENTS

| | | | |
|---|---|---|---|
| 3,533,795 | 10/1970 | Blaumueller | 430/535 |
| 3,615,557 | 10/1971 | D'Cruz | 430/535 |
| 3,833,403 | 9/1974 | Kogure et al. | 430/534 |
| 4,124,395 | 11/1978 | Ochiai et al. | 430/535 |
| 4,166,050 | 8/1979 | Miyazako et al. | 430/625 |
| 4,167,414 | 9/1979 | Morgan | 430/535 |
| 4,197,129 | 4/1980 | Muroi et al. | 430/625 |
| 4,225,665 | 9/1980 | Schadt | 430/535 |
| 4,275,137 | 6/1981 | Verhoof | 430/160 |

*Primary Examiner*—Charles L. Bowers, Jr.

*Attorney, Agent, or Firm*—Nicholas A. Camasto; Donald C. Kolasch

[57] ABSTRACT

A method is disclosed for preparing an oleophilic drafting film and related light-sensitive reprographic member. An aqueous drafting composition is disclosed which is both compatible with hydrophobic material and diazo light-sensitive compositions which provides for an expedient method of fabricating drafting film. The drafting composition comprises an acrylic resin emulsion containing an aziridine hardening agent.

5 Claims, No Drawings

DIAZO MATERIAL WITH WATERBORNE DRAFTING SUBBING COMPOSITION OF ACRYLIC RESIN AND AZIRIDINE AND PROCESS OF USING

BACKGROUND OF THE INVENTION

The present invention relates to an aqueous system for applying a drafting composition to the surface of a substrate to provide a drafting film and, more specifically, to an aqueous coating composition for a hydrophobic sheeting material which is also compatible with a diazo light-sensitive coating composition.

Support substrates prepared from hydrophobic resins, such as polyester resins, have proved highly satisfactory for use in the manufacture of reprographic film products. Matte-surfaced polyester sheeting material has found wide acceptance as specialty materials in engineering, drafting and related uses. Such matte-surfaced polyester sheeting may be used as a member on which ink and pencil drawings can be made or it can be overcoated with a suitable light-sensitive emulsion to provide a reprographic film product for use in graphic reproduction art. The coating of a drafting lacquer onto a film base from conventionally used solvent systems to provide the drafting properties of the coated film has not only proved to be costly due to the use of the organic solvents, but the solvents used present safety hazards and have a negative impact upon the environment such that expensive solvent recovery systems must be utilized to dispose of the solvents by environmentally accepted procedures. The substitution of aqueous coating systems in place of conventional solvent systems has major advantages due to their environmental considerations, safety and cost requirements. The use of waterborne systems eliminating the need for solvent recovery greatly reduces the problems of waste disposal. However, the coating of a drafting lacquer onto a film base from an aqueous emulsion rather than the commonly used solvent systems is not without its disadvantages. The coating produced from a waterborne system does not readily adhere to or coat evenly the surface of a hydrophobic material which intrinsically repels water. Furthermore, it is difficult to find waterborne resins capable of providing the desired drafting properties and, at the same time, be compatible with a reprographic film coated thereover, particularly a diazo imaging composition.

SUMMARY OF THE INVENTION

Therefore, it is an object of the present invention to provide an aqueous coating composition for a hydrophobic sheeting material to be used in combination with a diazo imaging composition which will overcome the above-noted and other disadvantages.

A further object of the present invention is to provide an aqueous drafting lacquer coating composition which will replace the presently used organic solvent system, thus eliminating the many disadvantages inherent therein.

Still, a further object of the present invention is to provide a waterborne drafting lacquer coating composition compatible with an oleophilic support substrate.

Yet, still a further object of the present invention is to provide a waterborne drafting lacquer coating composition compatible with a diazo light-sensitive imaging composition.

Another object of the present invention is to provide a method for preparing a novel oleophilic drafting film.

Yet, still another object of the present invention is to provide a diazo imaging member and a method for fabricating the instant member utilizing an aqueous drafting lacquer coating composition compatible with a diazo light-sensitive film.

DETAILED DESCRIPTION OF THE INVENTION

The foregoing objects and others are accomplished in accordance with the present invention, generally speaking, by providing an aqueous base drafting lacquer composition for use in the preparation of a light-sensitive reprographic imaging member particularly adaptable to engineering drafting requirements comprising an acrylic resin containing a unique hardening agent which is capable of producing a drafting surface with the desired hardness required of a sheet of drafting material while also providing the required adhesion for the acrylic layer to an underlying hydrophobic substrate. In addition, the aqueous drafting lacquer composition of the present invention is compatible with diazo light-sensitive coating compositions superimposed thereon. The hardening agent of the present invention comprises specifically aziridine, an ethyleneimine cross-linking agent.

Following the application of the coating composition to a hydrophobic film base and subsequent to drying, the resulting drafting film is coated with a diazo light-sensitive composition for subsequent utilization in a conventional diazo imaging process. In one of the more commonly practiced diazo processes, often referred to as a one-component or semi-moist development process, the light-sensitive diazo material contains a diazo compound in the absence of a coupler and the development step in the process utilizes a developer solution containing a coupler for the diazo-type material. In the other of the more conventionally used systems referred to as a two-component or dry development process, the light-sensitive diazo material contains both the diazo compound and the coupling component or components and the development step consists of exposing the diazo-type material to an alkaline environment such as ammonium or amine vapors. The resulting coated member is selectively exposed to actinic radiation with the diazonium composition decomposing in the light-exposed areas to produce a relatively colorless product which is inactive during further processing. The latent image produced on the diazo reprographic film is then developed by one of the above techniques, depending upon the presence of the coupler in the diazo composition or in the developer solution. The coupler reacts with the unexposed portions of the diazo composition to produce a visible dye image. The diazo composition can be easily removed by a rubber eraser or the like, if desired, in which case the underlying drafting surface being of sufficient hardness and having the desired pencil and ink receptivity properties can be written upon or the image otherwise modified as required. The aqueous base drafting lacquer composition of the present invention provides the necessary hardness required of a drafting surface and also produces the necessary adhesion for the acrylic layer with the underlying oleophilic substrate. In addition, when coated by a reprographic emulsion, such as the diazo composition as herein defined, the drafting lacquer coating will not interact with the diazo layer, thus eliminating any predevelopment of the unexposed diazo composition.

It has been determined in the course of the present invention that a drafting sheet can be prepared by coating a drafting lacquer onto a film base from an aqueous emulsion which has the necessary hardness, adhesion properties and diazo compatibility properties which heretofore have not been realized. It has been specifically determined that, by utilizing the particular aziridine hardening agent of the present invention in combination with an acrylic resin, a drafting surface is obtained having the necessary hardness while also providing the required adhesion for the underlying hydrophobic substrate. The instant coating composition is also compatible with both the exposed and unexposed areas of an overcoated diazo light-sensitive coating composition.

Suitable sheeting which may be used as the substrate in the present invention are preferably polyester resins, such as polyethylene terephthalate, poly(1,4-cyclohexyldimethylene phthalate) and other similar oleophilic materials such as polyvinyl chloride, polyethylene and polytetrafluoroethylene. The thickness of the base film sheet material employed in practicing the present invention is not considered critical. A polyester sheeting of a thickness of from about 2 to 50 mils can be employed satisfactorily. Usually, for reprographic products, the thickness of the polymeric or polyester sheeting used will be on the order of from about 3 to 5 mils.

The drafting coating composition of the present invention comprises an acrylic resin inclusive of the aziridine cross-linking or hardening agent which, in addition to providing the desired hardness properties, also exhibits the required adhesion of the acrylic layer to the underlying substrate, such as the polyester film, which is inherently oleophilic. Although many acrylic emulsions and hardening agents were tested, it has been determined that the specific combination of the aziridine hardening agent and acrylic resin presents a product produced from a waterborne system which is compatible with diazo compositions, sufficiently hard, and adequately adheres to the underlying polyester film. The drafting coating is applied to a dried thickness of from about 7.5 to 15 microns.

Any suitable acrylic resin may be utilized in combination with the specific aziridine hardening agent to realize the results of the present invention. Specifically suited for the present invention is an acrylic resin identified as Hycar 2600×237, a hard acrylic copolymer latex commercially available from B. F. Goodrich & Co. Another typical tough, flexible acrylic polymer latex film is commercially available from Polyvinyl Chemical Industries identified as Neocryl-A 604. The particular combination of resin and hardening agent produces a highly regarded drafting sheet.

The hardening agent of the present invention comprises a polyfunctional aziridine (ethyleneimine) which imparts flexibility, improves solvent, alcohol and water resistance, increases hardness and dramatically enhances adhesion in waterborne systems. The hardening agent is made available under the name XAMA-2 which is commercially available from Cordova Chemical Company. It has an aziridine content of from 6.00–7.00 meq/g, exhibiting an aziridine functionality of approximately 2.7.

The remaining components of the lacquer solution are conventionally added ingredients inclusive of dispersing agents, thickening agents, fillers and other additives which enhance the hardness property and coating rheology of the resulting film. The remaining ingredients in the formulations, such as isopropyl alcohol, butyl cellulose and butyl carbitol, are added to control the viscosity, drying rate and surfactant properties for machine coating. Other similar materials may be provided to obtain the same results.

In utilizing the drafting sheet of the present invention in combination with a diazo light-sensitive composition, any suitable diazo compound may be used. Typical diazo compounds include 2,5-diethoxy-4-morpholino benzene diazonium zinc chloride, 2,5-diethoxy-4-o-tolylmercapto benzene diazonium chloride, 2,5-dimethoxy-4-o-tolylmercapto benzene diazonium chloride and 4-methyl amino-3-(p-chlorophenoxy)-6-chlorobenzene diazonium chlorizincate. A hydrolyzed vinyl acetate homopolymer component of the diazo imaging composition of the present invention is generally present in the light-sensitive composition in an amount ranging from about 2 to 8 percent. The diazo formulation is thoroughly blended by conventional techniques and coated on the surface of a support substrate to a thickness of from about 15 to 50 microns. The diazo composition may be coated on either side of the drafting film; in either case it must be compatible with the drafting coating due to the fact that when stored the film is rolled into itself, thus the back-surface of the support for the film will come into immediate contact with the drafting coating. The diazo composition is coated on the surface of the dried lacquer film to a thickness of from about 15 to 50 microns.

PREFERRED EMBODIMENTS

To further define the specifics of the present invention, the following examples are intended to illustrate and not limit the subject matter of the present invention. Parts and percentages are by weight unless otherwise indicated. The examples are intended to illustrate preferred embodiments of the present invention.

EXAMPLE 1

The following dispersion was prepared by standard dispering techniques.

| | |
|---|---|
| Water | 220 g |
| Isopropanol | 66 g |
| Ammonium Hydroxide | 1.9 g |
| Butyl Cellosolve (commercially available from Union Carbide) | 33 g |
| Butyl Carbitol (commercially available from Union Carbide) | 55 g |
| Tamol 850 (dispersant) (commercially available from Rohm & Haas) | 1.5 g |
| titanium dioxide | 1.9 g |
| silica | 221 g |

To 491 grams of this dispersal is added 344 g of an aqueous solution of Hycar 2600×237, acrylic resin commercially available from B. F. Goodrich, 8.1 grams of aziridine (XAMA-2) commercially available from Cordova Chemical Co., 37 grams of water, 18 grams of Isopropanol and 2.2 grams of ammonium hydroxide. Following mixing of the resulting dispersion, a 0.4 mil film is coated by a rod coater onto a Mylar (polyethylene terephthalate) film. The resulting coating is dried at a temperature of about 225° F. for about 30 sec. and the resulting drafting film tested for pencil and ink receptivity. The results were positive, and adhesive tests with respect to the adhesion of the coated film to the surface of the polyester substrate indicated good adhesion.

After drying of the film, a diazo composition comprising the following formulation is applied to the surface of the coated Mylar (polyester) member by a conventional Myer coating technique to a film thickness of about 25 microns.

| Diazo Formulation | |
|---|---|
| Ethanol | 566.7 g |
| Water | 197.0 g |
| Carbopol EX-17 | 121.2 g |
| Minusil 5 | 40.0 g |
| Trihydroxy diphenyl | 3.0 g |
| 2,5-diethoxy-4-p-tolylmercapto benzene diazonium chloride | 15.0 g |
| Polyvinyl acetate (40% Hydrolyzed) | 100.0 g |
| Quso G-32 | 40.0 g |
| Rice Starch | 80.0 g |
| Phosphoric acid | 0.4 ml |
| p-toluene sulfonic acid | 0.5 g |
| Cymel 303 | 33.0 g |
| 2% AC Dye Solution | 12.5 ml |

| | |
|---|---|
| Carbopol EX-17 | A water solution of polyacrylic acid having a molecular weight in the range of 300,000–500,000, commercially available from the B. F. Goodrich Company. |
| Minusil 5 | uniform micron-sized grade of high purity crystalline silica commercially available from Pennsylvania Glass Sand Corp. |
| Quso G-32 | A silica composition commercially available from The P. Q. Corp. |
| AC Dye | A water soluble blue tinting dye. |
| Cymel 303 | A hexamethoxymethylmelamine resin commercially available from American Cyanamid. |

The ingredients of the above formulation are mixed in a Waring blender for 2 minutes. After blending, the solution is coated onto the above drafting film. The coating is applied by the conventional Myer coating technique to a film thickness of about 25 microns. This film is dried and exposed to an engineering drafting line original in a Bruning 820 ammonia-type process diazo machine. The resulting diazo image produced illustrates that the drafting lacquer coating is completely compatible with both the exposed and unexposed diazo material.

EXAMPLE 2

A dispersion of the following ingredients is prepared on a production scale:

| A. Dispersion | Charge for Daysolver | Wt. % |
|---|---|---|
| Water (deionized) | 117 lbs | 20.3564 |
| Isopropanol | 35 lbs | 6.0895 |
| Buty Cellosolve | 17.5 lbs | 3.0448 |
| Butyl Carbitol | 29 lbs | 5.0456 |
| Ammonium Hydroxide | 500 ml | .1726 |
| Amergel 100 | 265 gm | .1016 |
| Tamol 850 | 100 gm | .0384 |
| Titanium Dioxide (2010 | 450 gm | .1726 |
| Syloid 161 | 9.5 lbs | 1.6529 |
| Minusil, 5 micron | 108 lbs | 18.7906 |
| | 318.8 lbs | |
| **B. Crosslinker** | | |
| Water (deionized) | 5,000 gm | 2.5907 |
| Isopropanol | 3,900 gm | 2.0207 |
| Ammonium Hydroxide | 500 ml | .2332 |
| XAMA-2 | 1,760 gm | .9119 |
| | 24.5 lbs | 100.0000 |

-continued

| C. Drafting Composition | 45 gal batch (lb) | Wt. % |
|---|---|---|
| Dispersion | 236 | — |
| Hycar 2600 × 237 (Acrylic Latex) | 165 | 38.7785 |
| Crosslinker | 24.5 | — |
| | 425.5 lbs | |

A 45 gallon batch of the aqueous drafting composition is prepared comprising 236 pounds of the dispersion mix (A) prepared above, 165 pounds of the acrylic resin aqueous dispersion and 24.5 pounds of a cross-linking composition (B) comprising 5,000 grams of water, 3,900 grams of Isopropanol, 500 ml of ammonium hydroxide and 1,760 grams of aziridine (XAMA-2). The resulting dispersion (C) is further mixed and coated with a rod coater onto a Mylar film to a thickness of 0.5 ml. Following drying, the resulting drafting film is tested as to its acceptability to pencil and ink writing and with respect to its adherence for the underlying oleophilic polyester (Mylar) substrate. All of the tests proved to be positive.

A diazo light-sensitive composition of the following formulation is coated on the surface of the dried lacquer film to a thickness of about 20 microns and dried.

| Diazo Formulation | |
|---|---|
| Ethanol | 566.7 g |
| Water | 197.0 g |
| Carbopol EX-17 | 121.2 g |
| Minusil | 40.0 g |
| Zeothix 95 | 50.0 g |
| Trihydroxy diphenyl | 3.0 g |
| 2,5-diethoxy-4-o-tolylmercapto benzene diazonium chloride | 15.0 g |
| Polyvinyl acetate (40% Hydrolyzed) | 100.0 g |
| Rice Starch | 40.0 g |
| Phosphoric Acid | 0.4 g |
| p-toluene sulfonic acid | 0.5 g |
| Cymel 303 | 33.0 g |
| 2% AC Dye Solution | 12.5 ml |

Subsequent exposure and development of the diazo composition in an amine vapor environment produced a diazo image on the surface of the member. The presence of the specific aziridine hardening agent eliminated all predevelopment of the unexposed diazo composition.

The utilization of the aziridine as a hardening agent for the specific acrylic resin latex not only produces a drafting surface with the desired hardness but also gives the required adhesion of this acrylic layer to the hydrophobic substrate. Although many other agents were tested, the aziridine produced the desired coated product. The double advantage of the aziridine to harden the resin and improve adhesion without having an adverse effect on diazo coatings was unexpected. At the same time, the Hycar 2600×237 acrylic resin proved to be the resin of choice, although other acrylic resins may also be substituted with similar results.

Although the present examples were specific in terms of conditions and materials used, any of the above-listed typical materials may be substituted where suitable, in the above examples, with similar results being obtained. In addition to the steps used to carry out the process of the present invention, other steps or modifications may be used if desirable. In addition, other materials may be incorporated into the formulation of the present invention which will enhance, synergize or otherwise desirably affect the properties of the lacquer formulation for its present use.

Those skilled in the art will have other modifications occur to them based on the teachings of the present invention. These modifications are intended to be encompassed within the scope of the present invention.

What is claimed:

1. A light sensitive imaging member capable of being written on and erased with increased hardness and enhanced adhesion consisting essentially of an oleophilic support substrate, a dried drafting layer coated from a waterborne latex dispersion consisting essentially of the reaction product of an acrylic resin and an aziridine cross-linking agent on at least one surface thereof and a layer of a light-sensitive diazo composition on at least one surface of said drafting layer.

2. The imaging member of claim 1, wherein said dried acrylic resin layer is from 7.5 to 15 microns thick and said diazo layer has a thickness of from 15 to 50 microns.

3. An imaging process which comprises providing the light-sensitive imaging member of claim 1, selectively exposing said diazo composition to actinic radiation, and developing said exposed composition to an alkaline environment in the presence of a coupling agent for said diazo composition to produce a visible image.

4. The method of claim 3, wherein said alkaline environment comprises ammonia vapors.

5. The method of claim 3, wherein said alkaline environment comprises amine vapors.

* * * * *